United States Patent [19]

Kuhn et al.

[11] 4,087,770

[45] May 2, 1978

[54] INDUSTRIAL RELAY

[75] Inventors: Edward H. Kuhn, Milwaukee; John S. Hart, Racine, both of Wis.

[73] Assignee: Allen-Bradley Company, Milwaukee, Wis.

[21] Appl. No.: 700,837

[22] Filed: Jun. 29, 1976

[51] Int. Cl.[2] ..... H01H 67/02

[52] U.S. Cl. ..... 335/132; 335/197; 335/202

[58] Field of Search ..... 335/131, 132, 197, 202, 335/203

[56] References Cited

U.S. PATENT DOCUMENTS

| | | | |
|---|---|---|---|
| 3,368,171 | 2/1968 | Conner et al. | 335/132 X |
| 3,458,838 | 7/1969 | Isler | 335/132 |
| 3,548,349 | 12/1970 | Fujita | 335/132 |
| 3,964,006 | 6/1976 | Lacan | 335/202 |

*Primary Examiner*—George Harris
*Attorney, Agent, or Firm*—Quarles & Brady

[57] ABSTRACT

Three cartridge housings are mounted one on top of the other and atop a magnet assembly. Each defines a set of four compartments which receive and hold a contact module containing a set of contacts. The magnet assembly includes a magnetic circuit comprised of a resiliently mounted stationary yoke assembly and an armature assembly which is fastened to a drive yoke that is slidably mounted to the magnet housing for reciprocal motion along an actuation axis. The reciprocal motion of the drive yoke is coupled to each of the contact modules by a series of drive links which extend upward through the center of the cartridge housings and associated crossbars which extend laterally outward therefrom.

9 Claims, 9 Drawing Figures

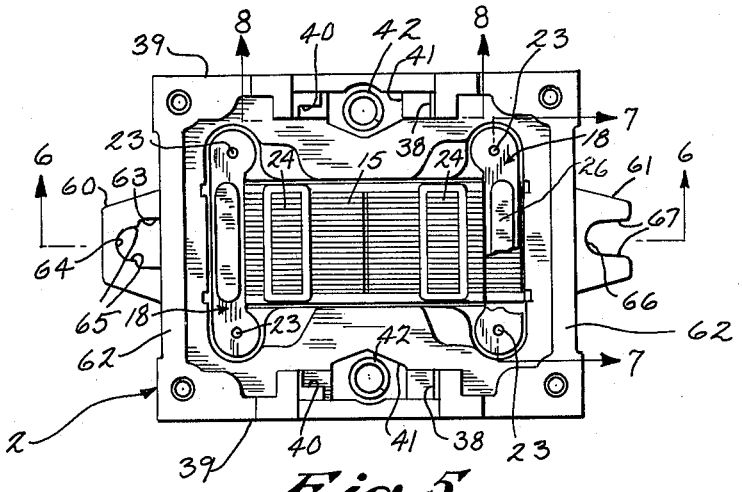
Fig.5
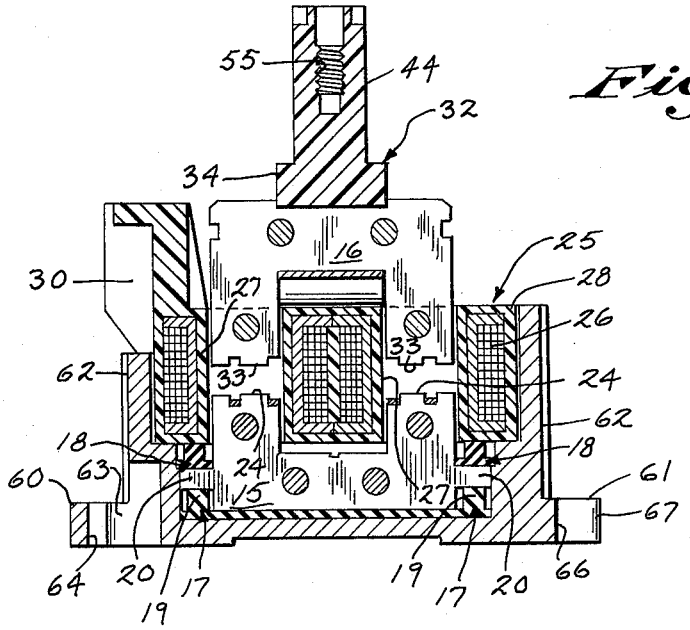
Fig.6
Fig.7
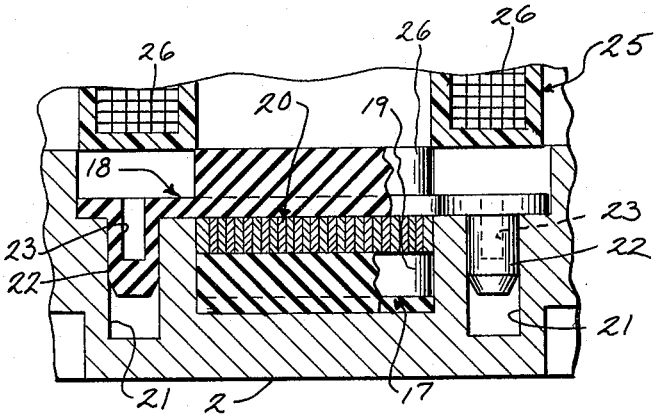
Fig.8
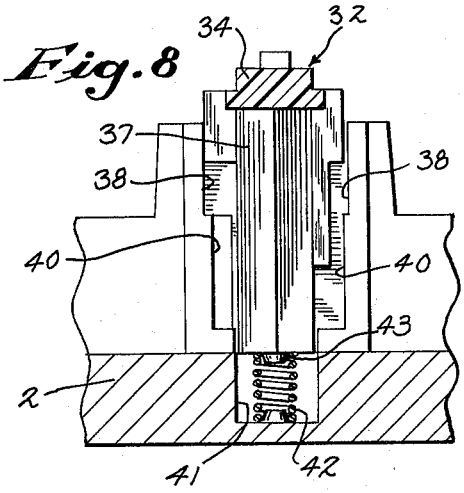

INDUSTRIAL RELAY

BACKGROUND OF THE INVENTION

The field of the invention is electrical relays, and particularly, relays for industrial control systems. Relays may be employed separately or in combination with large numbers of similar relays to form control systems for operating machine tools and other industrial equipment. Such relays are known for their reliability and long life which makes them particularly desirable for industrial applications where faults in the control system may result in expensive down time.

In addition to being reliable, such relays must be compact to facilitate mounting large numbers of them in a minimal space. These requirements necessitate the use of small but powerful electromagnet structures which will operate a large number of electrical contacts for millions of operating cycles. Such relays are illustrated in U.S. Pat. Nos. 3,251,964; 3,453,571; 3,519,967; and 3,451,018.

SUMMARY OF THE INVENTION

The present invention relates to an improved relay which is compact, reliable and easy to maintain. More particularly, the improved relay includes a one-piece magnet housing which encloses a resiliently supported yoke assembly having a pair of pole faces, a drive yoke which includes a pair of legs that are slidably received in guideways formed in the magnet housing on opposite sides of the yoke assembly, and an armature assembly carried by the drive yoke along an actuation axis between an actuated position in which a pair of pole faces on the armature assembly engage the pole faces on the yoke assembly, and an unactuated position in which they are spaced apart. Bias springs are disposed between the ends of each drive yoke leg and the magnet housing to urge the drive yoke and attached armature assembly to its unactuated position and a coil module is disposed within the magnet housing and operable when energized to generate a magnetic field which translates the drive yoke and attached assembly to the actuated position.

One or more cartridge housings are mounted atop the magnet housing and drive links extend therethrough along the actuation axis to couple the reciprocal motion of the drive yoke with a set of contact modules mounted in each cartridge housing. Crossbars attach to the drive links and extend laterally outward therefrom on opposite sides of the actuation axis to engage both the top and bottom ends of spanner guides which are slidably mounted within each contact module. A driving force is thus coupled to slide the spanner guides in either direction along the actuation axis.

When more than one cartridge housing is employed, the drive links are coupled together by a coupling screw which extends through an opening in each drive link and into threaded engagement with the drive yoke. The coupling screw includes a threaded portion associated with each drive link and when disengaged from the drive yoke, the drive links are loosely retained together as an integral assembly. The cartridge housings are similarly retained together by stack bolts which extend through openings in each.

A general object of the invention is to provide a rugged, compact and long-lived magnet structure for an industrial relay. The slidable mounting of the drive yoke legs in the guideways provides a relatively friction-free arrangement which reduces wear and increases the efficiency of the magnet. The stationary yoke assembly is resiliently mounted to the magnet housing by a lower shock pad which is disposed therebeneath and upper shock pads which strap it in place. Wear on the entire magnet assembly due to the repeated sliding motion of the drive yoke and impact of the pole faces on the armature and yoke assemblies is thus reduced.

Another general object of the invention is to provide a relay which is easily inspected and maintained. The coupling screws and stack bolts may be loosened to disengage one or more cartridge housings from the magnet housing. The cartridge housing and associated drive links thus removed are loosely retained together as an integral assembly so that parts thereof are not dropped or lost during examination or replacement of the contact modules.

A more specific object of the invention is to facilitate mounting and connection of the relay. Unique mounting flanges having tapered openings allow the magnet housing to be tightly secured to a mounting track using either of the two standard screw sizes. Ramp portions molded into the cartridge housings adjacent each contact cartridge terminal cooperate with molded divider walls to guide the ends of wires that are to be attached to the terminals and to thereby facilitate the connection procedure.

The foregoing and other objects and advantages of the invention will appear from the following description. In the description reference is made to the accompanying drawings which form a part hereof and in which there is shown by way of illustration a preferred embodiment of the invention. Such embodiment does not necessarily represent the full scope of the invention, however, and reference is made therefore to the claims herein for interpreting the scope of the invention.

BRIEF DESCRIPTION OF THE DRAWINGS

FIG. 5 is a top view with parts cut away of the magnet housing, mounted yoke assembly and bias springs which form a part of the magnet assembly of FIG. 4, FIG. 6 is a view in cross section with parts shown in whole of the magnet assembly taken along the plane 6—6 indicated in FIG. 5, FIG. 7 is a partial view in cross section with parts shown in whole of the magnet assembly taken along the plane 7—7 indicated in FIG. 5, FIG. 8 is a partial view in cross section with parts shown in whole of the magnet assembly taken along the plane 8—8 indicated in FIG. 5.

DESCRIPTION OF THE PREFERRED EMBODIMENT

Figure 1:
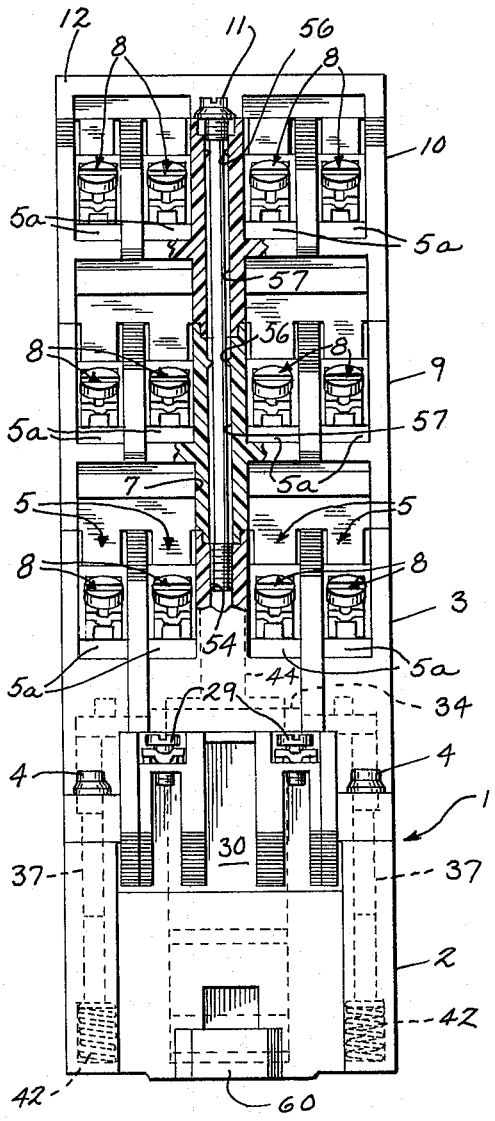
FIG. 1 is a front elevation view of the invented relay with parts cut away and parts shown in phantom.
Figure 2:
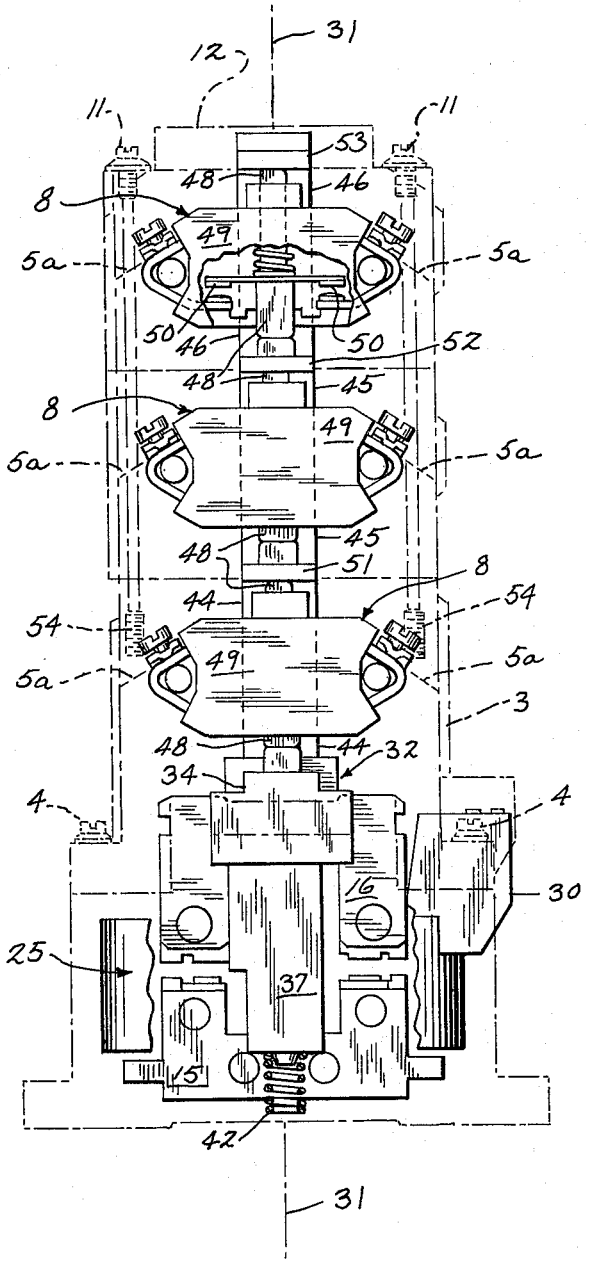
FIG. 2 is a side elevation view of the relay of FIG. 1 with the housing shown in phantom.
Figure 3:
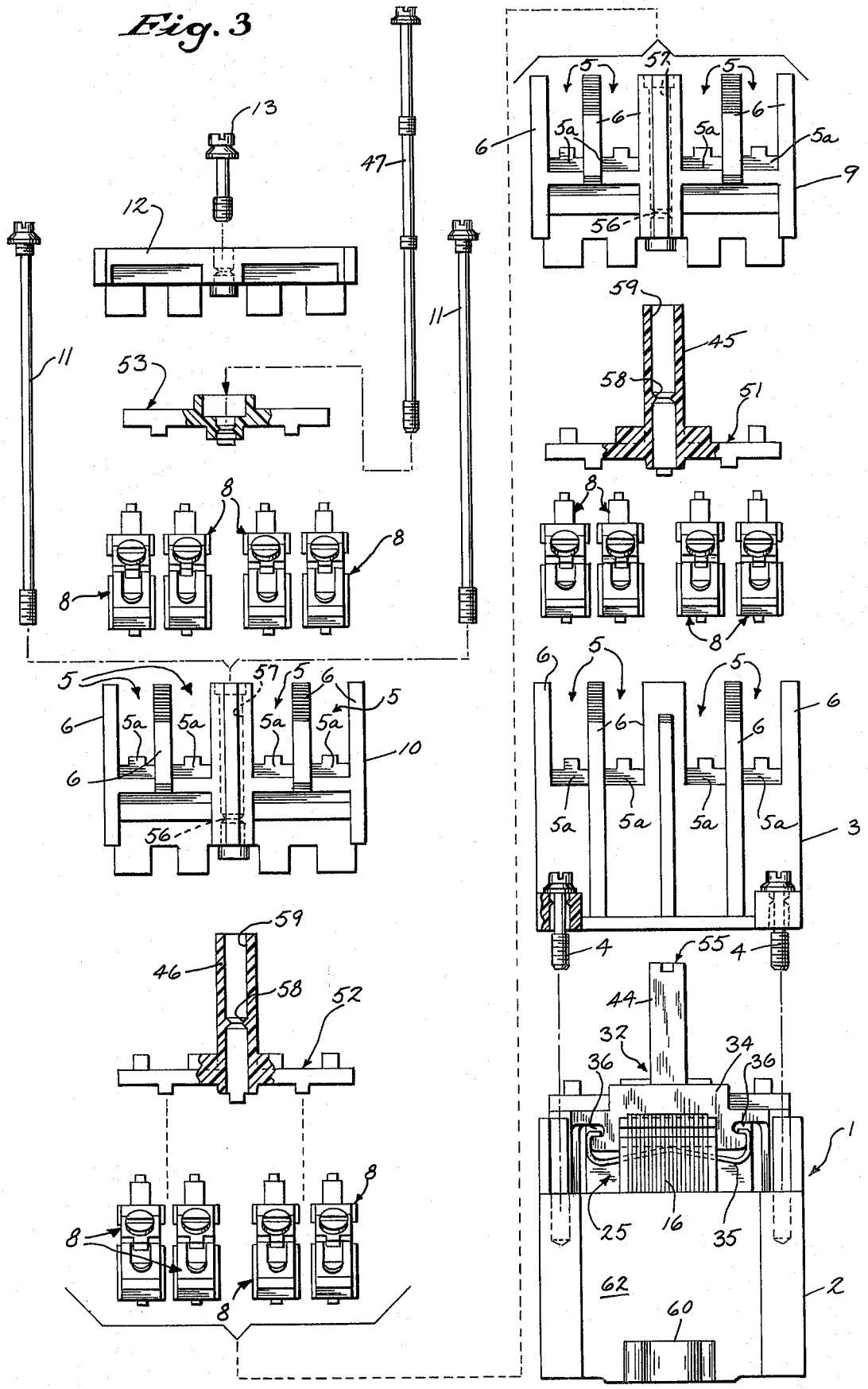
FIG. 3 is an exploded front view with parts cut away of the relay of FIG. 1.
Figure 4:
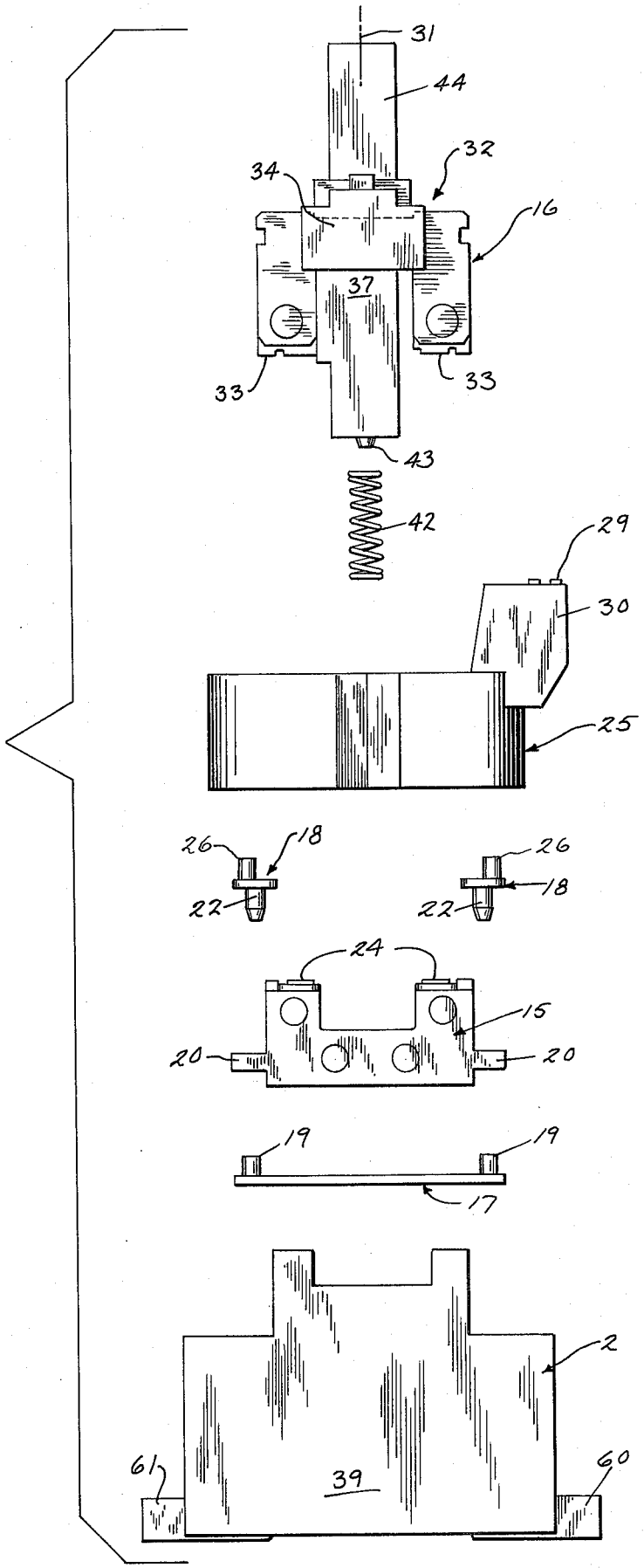
FIG. 4 is an exploded side view of the magnet assembly which forms part of the relay of FIG. 1.

Referring particularly to FIGS. 1–3, the relay includes a magnet assembly 1 which is enclosed in a single piece, die-cast aluminum, magnet housing 2. A lower cartridge housing 3 is mounted atop the magnet assembly 1 by a set of four screws 4 which extend downward into threaded openings formed in the magnet housing 2. The cartridge housing 3 is molded from a plastic insulating material and it defines a set of four compartments 5 which are electrically insulated from one another by upstanding divider walls 6. The compartments 5 are symmetrically disposed to either side of a rectangular central opening 7 which extends vertically through the center of the cartridge module 3 and communicates with its upper and lower surfaces. The compartments 5 are each shaped to receive and hold a contact module 8 such as that disclosed in copending U.S. Patent Application Ser. No. 588,600 entitled "Terminal for Convertible Contact Module" and a sloped surface, or ramp portion 5*a* is formed between each divider wall 5 adjacent each contact module terminal. A wire which is to be attached to the terminal of a contact module 8 is thus confined by the divider walls 5 on either side and guided by the ramp portion 5*a* into engagement therewith.

Figure 9:
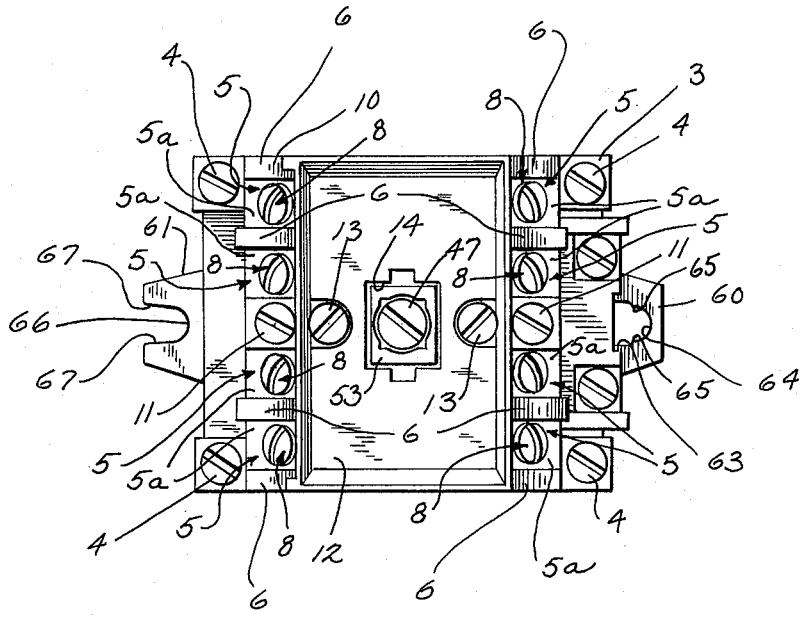
FIG. 9 is a top view of the relay of FIG. 1.

A middle cartridge housing 9 and an upper cartridge housing 10 are mounted atop the lower housing 3 by a pair of stack bolts 11. The cartridge housings 9 and 10 are similar to the lower cartridge housing in that each provides four compartments 5 for receiving and holding four contact modules 8. A molded plastic insulating top 12 is fastened to the top of the upper cartridge housing 10 by a pair of screws 13. As shown best in FIG. 9, the top has a substantially rectangular shape and includes an opening 14 at its center which aligns with the central openings 7 that extend downward through the cartridge housings 3, 9 and 10. The relay shown and described herein thus mounts twelve contact modules 8, however, it should be apparent to those skilled in the art that this number can be changed by adding or removing cartridge housings.

Referring particularly to FIGS. 4–8, the magnet assembly 1 includes an electromagnet having a magnetic circuit comprised of a stationary, U-shaped yoke assembly 15 and a movable, U-shaped armature assembly 16. The yoke assembly 15 is formed from steel laminations and is resiliently mounted to the bottom of the magnet housing 2 by a molded elastomer lower shock pad 17 and a pair of molded elastomer upper shock pads 18. The lower shock pad 17 has a rectangular shape and it extends over substantially the entire underside of the yoke assembly 15. Two upstanding end portions 19 are formed on the pad 17 and engage the underside of ears 20 which extend laterally outward from opposite ends of the yoke assembly 15. The upper shock pads 18 extend across the top surfaces of these ears 20 and are anchored in openings 21 formed in the bottom of the magnet housing 2 on opposite sides of each ear 20. An integrally formed, downward extending proboscis 22 is formed on each end of the upper pads 18 and these are tightly received in the openings 21 to strap the yoke assembly 15 in place. An opening 23 in each proboscis 22 receives a sharp tool which when inserted stretches the proboscis 22 to reduce its diameter during insertion into its opening 21. The yoke assembly 15 is thus resiliently held in place with its pair of pole faces 24 directed upwardly away from the bottom of the magnet housing 2.

A coil module 25 is disposed in the magnet housing 2 and rests upon rubber cushions 26 which are integrally formed on the top surface of each upper shock pad 18. The coil module 25 includes operating coils 26 which are wound around two openings 27 that receive the legs of the yoke assembly 15. A molded plastic encapsulation 28 surrounds the operating coils 26 and supports an integrally molded upstanding coil terminal support structure 30. Energizing current for the operating coils 26 is provided at a pair of terminals 29. When the screws 4 which retain the cartridge housing 3 in place are tightened, the coil module 25 is forced downward to slightly compress the rubber cushions 26. The yoke assembly 15 and the coil module 25 are thus firmly, but resiliently held in place.

The armature assembly 16 is formed from steel laminations similar to those employed in the yoke assembly 15. It is supported for reciprocal motion along an actuation axis 31 by a molded plastic drive yoke 32. The legs of the armature assembly 16 extend downward into the coil openings 27 and the pole faces 33 formed on the lower ends thereof are aligned with the pole faces 24 of the yoke assembly 15. When the operating coils 26 are energized, the armature assembly 16 is pulled downward to an actuated position in which its pole faces 33 impact with the yoke assembly pole faces 24.

The drive yoke 32 includes an integrally molded crossbar 34 which extends laterally outward to each side of the actuation axis 31. As shown best in FIG. 3, the armature assembly 16 is held to the underside of the crossbar 34 by a flexible metal strap 35 which has inwardly turned ends that are received in outwardly facing cavities 36. A snug, but yieldable attachment is thus made.

As shown best in FIGS. 1–5 and 8, downwardly extending legs 37 are formed on the ends of the drive yoke crossbar 34. The legs 37 straddle the magnet structure and are slidably received in guideways 38 which are formed on the interior of opposing magnet housing walls 39. The legs 37 are shaped to mate with the guideways 38 when the drive yoke 32 is assembled properly, but to interfere with a stop element 40 when an attempt is made to assemble it in reverse direction. Wells 41 are formed in the bottom of the magnet housing 2 beneath each guideway 38 and a bias spring 42 is disposed in each. The bias springs 42 are attached to the bottom of each well 41 and are retained in alignment against the lower end of the legs 37 by protruberances 43 formed thereon. The bias springs 42 provide an upward force along the actuation axis 31 which lifts the drive yoke 32 and attached armature assembly 16 to their unactuated position. When the coils 26 are energized, the armature assembly 16 and attached drive yoke 32 are pulled downward by the magnetic force against the spring bias force.

The reciprocal motion of the drive yoke along the actuation axis 31 is conveyed to each contact module 8 in the relay by a series of coupled drive links which extend through the central openings 7 formed in the cartridge housings 3, 9 and 10. As shown best in FIGS. 1–3, the first such drive link 44 is integrally formed to the top of the drive yoke 32 and extends upward through the central opening 7 in the lower cartridge housing 3. The second molded plastic drive link 45 mounts atop the first drive link 44 and extends upward through the opening 7 in the middle cartridge housing 9 and a third drive link 46 mounts atop the drive link 45 and extends upward through the opening 7 in the upper cartridge housing 10. The drive links 44, 45 and 46 are fastened together by a coupling screw 47 which extends downward through an opening formed in the drive links 45 and 46 and into a threaded opening 55 formed in the top of the drive link 44. The translational motion of the drive yoke 32 along the actuation axis 31 is thus conveyed upward through each cartridge housing to the top of the relay.

The translational motion of the drive links 44, 45 and 46 are conveyed to each of the contact modules 8 by crossbars which extend laterally outward therefrom. As described in the above cited copending patent application and as shown best in FIG. 2 herein, each contact module 8 includes a spanner guide 48 which is mounted to the module housing 49 for sliding motion along an operating axis which is parallel to the relay actuation axis 31. Each spanner guide 48 extends through openings in the top and bottom surfaces of the contact module housing 49. The sliding motion of the spanner guide 48 opens and closes a set of contacts 50 which are disposed in the module housing 49, and as described in the above cited copending patent application a normally open mode of operation is obtained with the contact module 8 oriented as shown in FIG. 2 and a normally closed mode of operation may be obtained by inverting, or revolving, the module 180° about a horizontal axis.

As shown best in FIGS. 2 and 3, the crossbar 34 associated with the drive yoke 32 engages the lower ends of the module spanner guides 48 contained in the lower cartridge housing 3. A similar crossbar 51 is integrally formed on the lower end of the second drive link 48 and it extends laterally outward therefrom and engages the upper ends of these same spanner guides 48. The spanner guides 48 in the lower cartridge housing 3 are thus captured between and positively driven in both directions by the crossbars 34 and 51 in response to the reciprocal motion of the drive yoke 32.

The second crossbar 51 also engages the lower ends of the module spanner guides 48 contained in the middle cartridge housing 9. A third crossbar 52 is integrally formed to the lower end of the third drive link 46 and it engages the tops ends of these same spanner guides 48 to capture them and control their motion. This third crossbar 52 also engages the lower ends of the module spanner guides 48 contained in the upper cartridge housing 10. A separate molded plastic crossbar 53 is fastened to the top of the third drive link 46 by the coupling screw 47 to engage the top ends of these same spanner guides 48. The spanner guides 48 in all of the contact modules 8 are thus operated simultaneously by the reciprocal motion of the drive links 44–46 along the actuation axis 31.

To inspect, invert or replace one of the contact modules 8 in the relay, it is necessary to loosen the stack bolts 11 and the coupling screw 47. As shown best in FIGS. 1–3, the stack bolts 11 are received in threaded openings 54 which are formed in the top of the lower cartridge housing 3 and the coupling screw 47 is received in the threaded opening 55 which is formed in the first drive link 44. When the stack bolts 11 and the coupling screw 47 are loosened, therefore, an assembly of elements which includes the top 12, upper cartridge housing 10, middle cartridge housing 9, the fourth crossbar 53 and the second and third drive links 45 and 46 may be lifted free of the magnet assembly 1 and the lower cartridge housing 3. The contact modules 8 contained in the lower cartridge housing 3 are thus exposed and may be removed by pulling them upward.

To maintain the disengaged assembly as an integral unit and to thus prevent the complete disassembly thereof during routine maintenance or repair of the contact modules 8, constrictions 56 are formed in the openings 57 which receive the stack bolts 11 in the middle cartridge housing 9 and upper cartridge housing 10. These constrictions 56 engage the threaded end of the stack bolts 11 to retain the middle cartridge housing 9 as an integral part of the disengaged assembly. The two cartridge housings 9 and 10 can be separated, or spread apart, however, to allow access to the contact modules 8 in the middle cartridge housing 9 and the top 12 can be removed to allow access to the contact modules 8 in the upper cartridge housing 10.

As shown best in FIG. 3, similar constrictions 58 within the openings 59 in the second and third drive links 45 and 46 cooperate with threaded portions on the coupling screw 47 to maintain them as an integral part of the disengaged assembly. Various degrees of disassembly can thus be achieved by unscrewing the drive links 45 and 46 from the coupling screw 47 to allow easy examination, repair or replacement of the various elements of the relay.

The relay is shown and described herein with the cartridge housings 3, 9 and 10 mounted atop the magnet housing 2 to provide an upright structure. It is well known in the art, however, that in most installations the magnet housing 2 is mounted to a vertical wall or mounting strip and that the relay extends forward therefrom in a substantially horizontal plane. Two mounting screws are employed to attach the relay to a mounting strip and although the hole spacing has been standardized in the industry for mounting relays from various manufacturers, the hole size has not. Both size 8 and size 10 screws are employed and their metric equivalents are finding increased use. As shown best in FIGS. 5, 6 and 9, to accommodate these various sized mounting screws, a pair of mounting ears 60 and 61 are formed on opposite end walls 62 of the magnet housing 2. The mounting ear 60 includes an enlarged opening 63 through which the head of a mounting screw may easily be passed, and a slot 64 which is contiguous therewith and is defined by tapered sides 65 which extend away from the housing wall 62. The mounting ear 61 includes a slot 66 which is defined by tapered walls 67 that extend toward the opposite housing wall 62. The slots 64 and 66 thus extend in the same direction and each is sufficiently wide at its narrow end to receive the shank of a number 8 screw and each is sufficiently wide at its mouth to receive a number 10 screw. Thus by translating the relay slightly in either direction with respect to the standard mounting holes, the relay can be mounted thereto with either sized screws.

A compact and reliable industrial relay has thus been described which mounts from one to twelve reversible contact modules. The magnet assembly is designed to provide millions of operations and the entire structure is easily disassembled to allow access to the contact modules without the complete removal of screws and other elements which might be dropped and become lost in the equipment cabinet.

We claim:

1. A relay, the combination comprising:

a cartridge housing which encloses and retains a set of electrical contacts;

a magnet assembly attached to said cartridge housing and including:

(a) a magnet housing having a bottom and a set of walls which define a cavity;

(b) a yoke assembly retained to the bottom of said magnet housing and disposed within said cavity, said yoke assembly having a pair of pole faces which are directed away from said bottom;

(c) a coil module disposed in said cavity and including an operating coil which is magnetically coupled to said yoke assembly;

(d) a drive yoke having a pair of laterally spaced legs which extend into said cavity on opposite sides of said yoke assembly and which are received by and slidably retained in guideways that are formed on the interior surfaces of opposing walls of said magnet housing;

(e) a pair of bias springs, one disposed between the magnet housing and one of said drive yoke legs and the other disposed between said magnet housing and the other of said drive yoke legs; and (f) an armature assembly fastened to said drive yoke and carried thereby between an unactuated position in which a pair of pole faces on the armature assembly are spaced from the pole faces on the yoke assembly and an actuated position in which the armature assembly pole faces engage the yoke assembly pole faces;

means coupling the drive yoke to a movable contact in said set of contacts;

wherein said yoke assembly is resiliently mounted to the bottom of said magnet housing by a lower shock pad which is formed from an elastomeric material which is disposed between the yoke assembly and the bottom of said magnet housing; and in which ears are formed on opposite ends of said yoke assembly and upper shock pads formed from an elastomeric material are disposed over said ears and anchored to the bottom of said magnet assembly to strap said yoke assembly in place.

2. A relay, the combination comprising:

a cartridge housing which encloses and retains a plurality of sets of electrical contacts;

a magnet assembly attached to said cartridge housing and including:

(a) a magnet housing having a bottom and a set of walls which define a cavity;

(b) a yoke assembly retained to the bottom of said magnet housing and disposed within said cavity, said yoke assembly having a pair of pole faces which are directed away from said bottom;

(c) a coil module disposed in said cavity and including an operating coil which is magnetically coupled to said yoke assembly;

(d) a drive yoke having a pair of laterally spaced legs which extend into said cavity on opposite sides of said yoke assembly and which are received by and slidably retained in guideways that are formed on the interior surfaces of opposing walls of said magnet housing;

(e) a pair of bias springs, one disposed between the magnet housing and one of said drive yoke legs and the other disposed between said magnet housing and the other of said drive yoke legs; and (f) an armature assembly fastened to said drive yoke and carried thereby between an unactuated position in which a pair of pole faces on the armature assembly are spaced from the pole faces on the yoke assembly and an actuated position in which the armature assembly pole faces engage the yoke assembly pole faces; and means coupling the drive yoke to a movable contact in each of said set of contacts, said coupling means including a drive link which connects to said drive yoke and extends through a central opening in said cartridge housing which communicates with its upper and lower surfaces and a pair of crossbars, each of which connects to said drive link and extends laterally outward from said drive link on opposite sides thereof to couple with the movable contact in each of said sets of contacts.

3. The relay as recited in claim 2 in which a second cartridge housing is mounted to said first cartridge housing and it encloses a plurality of sets of contacts, and said coupling means includes: a second drive link which connects to the first drive link and extends through a central opening in said second cartridge housing; and a crossbar which connects to said second drive link and extends laterally outward therefrom on opposite sides thereof to couple with the movable contact in each of said sets of contacts in said second cartridge housing.

4. A relay, the combination comprising:

a cartridge housing which encloses and retains a set of electrical contacts;

a magnet assembly attached to said cartridge housing and including:

(a) a magnet housing having a bottom and a set of walls which define a cavity;

(b) a yoke assembly retained to the bottom of said magnet housing and disposed within said cavity, said yoke assembly having a pair of pole faces which are directed away from said bottom;

(c) a coil module disposed in said cavity and including an operating coil which is magnetically coupled to said yoke assembly;

(d) a drive yoke having a pair of laterally spaced legs which extend into said cavity on opposite sides of said yoke assembly and which are received by and slidably retained in guideways that are formed on the interior surfaces of opposing walls of said magnet housing;

(e) a pair of bias springs, one disposed between the magnet housing and one of said drive yoke legs and the other disposed between said magnet housing and the other of said drive yoke legs; and (f) an armature assembly fastened to said drive yoke and carried thereby between an unactuated position in which a pair of pole faces on the armature assembly are spaced from the pole faces on the yoke assembly and an actuated position in which the armature pole faces engage the yoke assembly pole faces;

means coupling the drive yoke to a movable contact in said set of contacts;

a second cartridge housing mounted atop said first cartridge housing and including a pair of openings which extend downward therethrough and align with threaded openings in said first cartridge housing; and a third cartridge housing mounted atop said second cartridge housing and including a pair of openings which extend therethrough and align with the openings in said second cartridge housing, and in which constrictions are formed in said openings in said second and third cartridge housings and a pair of stack bolts, each having a threaded end portion extend through said aligned openings and into threaded engagement with said first cartridge housing, wherein disengagement of said stack bolts from said first cartridge housing allows disassembly of said second and third cartridge housings therefrom, but said constrictions engage said threaded portions to retain said second and third cartridges together as an integral assembly.

5. In a relay having a set of contacts enclosed in an insulating housing which mounts to a magnet assembly that operates said set of contacts by translating a drive link along an actuation axis, the magnet assembly comprising:

a magnet housing having a bottom and four upstanding side walls which define a cavity therebetween;

a lower shock pad formed of an elastomeric material disposed in said cavity on the bottom of said magnet housing;

a U-shaped yoke assembly disposed on said lower shock pad and having a pair of pole faces which are directed upward and away from the bottom of said magnet housing, said yoke assembly having a pair of ears which extend laterally outward from opposite ends thereof and which each have a lower surface that engages said lower shock pad;

a pair of upper shock pads formed of an elastomeric material, each disposed on a top surface of one of said respective ears;

a coil module disposed in said cavity and resting on said upper shock pads, said coil module including an operating coil which when energized generates magnetic flux to actuate the relay;

a drive yoke mounted for sliding motion along said actuation axis and coupled to said drive link; and a U-shaped armature assembly mounted to said drive yoke and having a pair of pole faces which are directed downward into said cavity and which engage the pole faces on said yoke assembly when the operating coil is energized to actuate the relay;

wherein said insulating housing engages said coil module and exerts a downward force thereon which compresses both said lower and upper shock pads.

6. The relay as recited in claim 5 in which each of said upper shock pads is anchored to the bottom of said magnet housing by a pair of proboscises which extend downward into openings formed in said bottom.

7. In a relay having a set of contacts mounted in an insulating housing which mounts to a magnet housing having a pair of opposing side walls and a pair of opposing end walls, the improvement therein comprising:

a first mounting ear connected to one of said magnet housing end walls and extending laterally outward therefrom, said first mounting ear having an opening formed therein through which the head of a mounting screw may pass, and having a slot portion which is contiguous with said opening and is defined by tapered sides which extend away from said housing end wall; and a second mounting ear connected to the other of said magnet housing end walls and extending laterally outward therefrom, said second mounting ear having a slot formed therein which is defined by tapered sides which extend toward said other housing end wall.

8. The relay as recited in claim 7 in which said magnet housing is a one-piece die cast structure and said mounting ears are integrally formed therewith.

9. A relay having a magnet assembly and a plurality of cartridge housings mounted one on top of the other to said magnet assembly, at least one of said cartridge housings comprising:

a plurality of spaced, upright divider walls which define compartments;

a plurality of contact modules, one disposed in each of said compartments; and a pair of openings formed through said cartridge housing for receiving stack bolts which fasten it to the relay, each of said openings including a constricted portion which allows free passage of a shank or the stack bolt therein, but engages a threaded portion of said stack bolt when the stack bolt is withdrawn therethrough.

* * * * *